US006647949B2

(12) United States Patent
Hosokawa et al.

(10) Patent No.: US 6,647,949 B2
(45) Date of Patent: Nov. 18, 2003

(54) CONTROL APPARATUS AND CONTROL METHOD FOR DIRECT INJECTION ENGINE

(75) Inventors: Osamu Hosokawa, Toyota (JP); Noboru Takagi, Toyota (JP); Takahide Kyuuma, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 134 days.

(21) Appl. No.: 09/983,280

(22) Filed: Oct. 23, 2001

(65) Prior Publication Data

US 2002/0046730 A1 Apr. 25, 2002

(30) Foreign Application Priority Data

Oct. 23, 2000 (JP) ..... 2000-323064

(51) Int. Cl.[7] ..... F02B 17/00
(52) U.S. Cl. ..... 123/295; 123/305
(58) Field of Search ..... 123/295, 305

(56) References Cited

U.S. PATENT DOCUMENTS

| | | | | | |
|---|---|---|---|---|---|
| 5,785,031 | A | * | 7/1998 | Akimoto et al. | 123/295 |
| 5,797,367 | A | * | 8/1998 | Iida et al. | 123/295 |
| 5,809,973 | A | * | 9/1998 | Iida et al. | 123/491 |
| 5,878,711 | A | * | 3/1999 | Kamura et al. | 123/305 |
| 5,970,950 | A | * | 10/1999 | Shimizu et al. | 123/295 |
| 5,988,136 | A | * | 11/1999 | Piock et al. | 123/295 |
| 6,044,642 | A | * | 4/2000 | Nishimura et al. | 123/295 |
| 6,050,232 | A | * | 4/2000 | Grob et al. | 123/295 |
| 6,062,191 | A | * | 5/2000 | Ooba | 123/295 |
| 6,125,816 | A | * | 10/2000 | Inoue | 123/295 |
| 6,240,896 | B1 | * | 6/2001 | Ueda et al. | 123/295 |
| 6,340,014 | B1 | * | 1/2002 | Tomita et al. | 123/295 |
| 6,347,612 | B1 | * | 2/2002 | Nishimura | 123/295 |
| 6,374,798 | B1 | * | 4/2002 | Nagai et al. | 123/295 |
| 6,378,484 | B1 | * | 4/2002 | Russell et al. | 123/295 |
| 6,386,173 | B1 | * | 5/2002 | Yamamoto et al. | 123/295 |
| 6,397,817 | B1 | * | 6/2002 | Yoshida et al. | 123/406.47 |

FOREIGN PATENT DOCUMENTS

| | | | | | |
|---|---|---|---|---|---|
| EP | 0 849 455 | A2 | | 12/1997 | |
| EP | 0 824 188 | A2 | | 2/1998 | |
| JP | 4-187841 | | | 7/1992 | |
| JP | 04187841 | A | | 7/1992 | F02D/41/02 |
| JP | 321747 | | * | 11/1992 | F02D/41/34 |
| JP | 4-321747 | | | 11/1992 | |
| JP | 10-030468 | | | 2/1998 | |
| JP | 145510 | | * | 5/2000 | F02D/41/06 |
| JP | 2000-145510 | A | | 5/2000 | |
| JP | 179433 | | * | 6/2000 | F02B/17/10 |
| JP | 2000-179433 | A | | 6/2000 | |
| JP | 2001-082216 | | | 3/2001 | F02D/41/06 |
| JP | 130015 | | * | 5/2002 | F02D/41/06 |
| JP | 2002-130015 | A | | 5/2002 | |

* cited by examiner

*Primary Examiner*—Henry C. Yuen
*Assistant Examiner*—Arnold Castro
(74) *Attorney, Agent, or Firm*—Kenyon & Kenyon

(57) ABSTRACT

A fuel-injected engine is operated in a compression stroke injection mode or an intake stroke injection mode. The intake flow rate appropriate for the compression stroke injection mode is greater than that of the intake stroke injection mode. When the engine is cold, the ECU determines the amount of fuel injected in accordance with the actual intake flow rate. The ECU controls a throttle valve such that the intake flow rate is appropriate for the selected fuel injection mode before the fuel injection mode is actually switched. As a result, fluctuations of the engine speed caused by switching the fuel injection mode are reduced.

12 Claims, 5 Drawing Sheets

CONTROL APPARATUS AND CONTROL METHOD FOR DIRECT INJECTION ENGINE

BACKGROUND OF THE INVENTION

The present invention relates to a control apparatus and a control method for an internal combustion engine that directly injects fuel into a combustion chamber.

Japanese Unexamined Patent Publication No. 4-187841 discloses a direct injection internal combustion engine. In the prior art engine, fuel is directly injected into a combustion chamber. Then, a spark plug ignites a mixture of air and fuel formed in the combustion chamber. The engine is operated in a fuel injection mode selected between an intake stroke injection mode, in which the fuel is injected during the intake stroke of the engine, and a compression stroke injection mode, in which the fuel is injected during the compression stroke of the engine. The fuel injection mode is switched in accordance with the running characteristics of the engine.

When the intake stroke injection mode is executed, the amount of fuel to be injected into the combustion chamber (fuel injection amount) is determined in accordance with the flow rate of intake air (intake flow rate) to the combustion chamber. The fuel injection amount is determined in accordance with the intake flow rate also when the compression stroke injection mode is executed while the engine is cold, or while the engine is not warm. However, the intake flow rate required for the execution of the compression stroke injection mode is greater than the intake flow rate required for the intake stroke injection mode.

As soon as the fuel injection mode is switched, a throttle valve of the engine operates such that the intake flow rate required by the selected fuel injection mode is made available. However, there is a time delay from when the throttle valve is operated to when the actual intake flow rate reaches the required value. Therefore, immediately after the fuel injection mode is switched, the actual intake flow rate and the fuel injection amount, which is determined in accordance with the intake flow rate, have not yet reached the levels required for the selected fuel injection mode. As a result, when the fuel injection mode is switched, the engine speed temporarily fluctuates.

For, example, when the fuel injection mode is switched from the intake stroke injection mode to the compression stroke injection mode while the engine is cold, the engine speed temporarily decreases. When the fuel injection mode is switched from the compression stroke injection mode to the intake stroke injection mode while the engine is cold, the engine speed temporarily increases.

BRIEF SUMMARY OF THE INVENTION

The objective of the present invention is to provide a control apparatus and a control method for a direct injection engine that reduces fluctuations of engine speed caused when switching fuel injection modes.

To achieve the foregoing and other objectives and in accordance with the purpose of the present invention, a control apparatus for an engine is provided. The engine includes an injector that directly injects fuel into a combustion chamber and a valve for controlling the flow rate of intake air to the combustion chamber. The engine is operated in a fuel injection mode selected from a first injection mode, in which the injector injects fuel during the compression stroke of the engine, and a second injection mode, in which the injector injects fuel during the intake stroke of the engine. The intake flow rate appropriate for the first injection mode differs from the intake flow rate appropriate for the second injection mode. The apparatus includes a controller for controlling the injector and the valve. When one of the fuel injection modes is selected, the controller controls the valve such that the intake flow rate is appropriate for the selected fuel injection mode. When the engine is cold, the controller determines the amount of fuel to be injected by the injector in accordance with the actual intake flow rate. The controller controls the valve such that the intake flow rate is appropriate for the selected fuel injection mode before actually switching the fuel injection mode by a predetermined time period.

The present invention also provides a method for controlling an engine that directly injects fuel into a combustion chamber. The method includes operating the engine in a selected one of a plurality of fuel injection modes. The injection modes include a first injection mode, in which the fuel is injected during the compression stroke of the engine, and a second injection mode, in which the fuel is injected during the intake stroke of the engine. The intake flow rate appropriate for the first injection mode differs from the intake flow rate appropriate for the second injection mode. The method further includes adjusting the intake flow rate to be appropriate for the selected fuel injection mode and determining the amount of fuel injected into the combustion chamber in accordance with the actual intake flow rate when the engine is cold. When a different injection mode is selected, the injection mode is switched to the selected injection mode after a delay that is sufficient to allow the intake flow rate to reach a level appropriate for the selected fuel injection mode.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
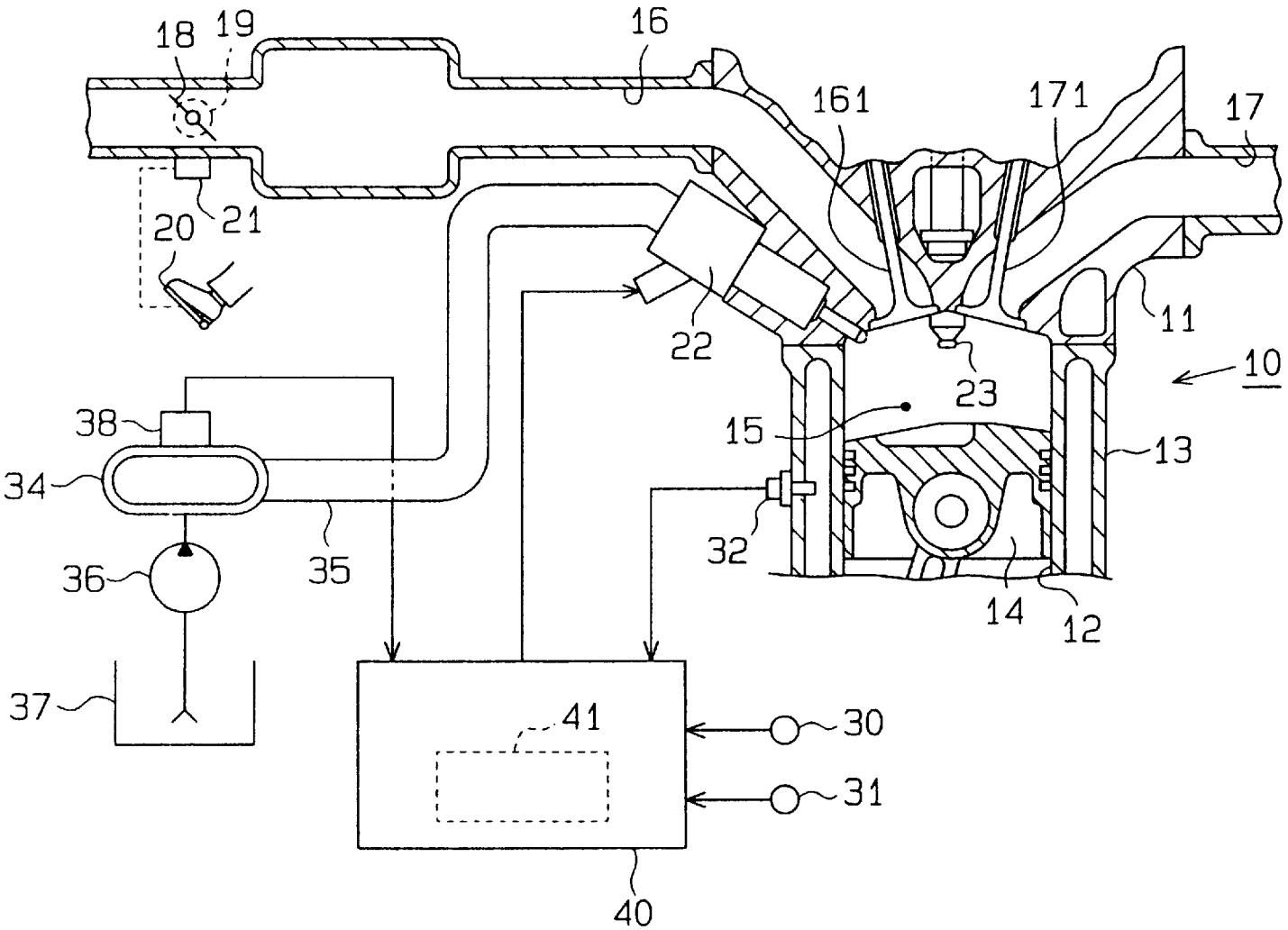
FIG. 1 is a schematic diagram of a control apparatus and an engine according to one embodiment of the present invention.

One embodiment of the present invention will now be described with reference to FIGS. 1 to 5. As shown in FIG. 1, an engine 10 includes a cylinder block 13, which has a plurality of cylinders 12 (only one cylinder is shown in FIG.

1), and a cylinder head 11, which is fastened above the cylinder block 13. A piston 14 is accommodated in each cylinder 12. A combustion chamber 15 is defined by each piston 14, the inner wall of the corresponding cylinder 12, and the cylinder head 11.

An intake passage 16 and a discharge passage 17 are connected to the combustion chambers 15. The intake passage 16 has a throttle valve 18 for adjusting the flow rate of intake air to the combustion chambers 15. The opening degree of the throttle valve 18 is adjusted by a throttle motor 19 based on the depression amount of an acceleration pedal 20. More specifically, the depression amount of the acceleration pedal 20 is detected by a pedal position sensor 21. Then, the opening degree of the throttle valve 18 is controlled by the throttle motor 19 based on the detected depression amount of the pedal 20. The opening degree of the throttle valve 18 is detected by a throttle position sensor (not shown). An intake temperature sensor (not shown) for detecting the temperature inside the intake passage 16 (intake temperature) is located upstream of the throttle valve 18. A catalytic device (not shown) for cleaning the emission gas is located inside the discharge passage 17.

Intake valves 161 are arranged in the cylinder head 11. Each intake valve 161 selectively connects and disconnects the corresponding combustion chamber 15 and the intake passage 16. Discharge valves 171 are arranged in the cylinder head 11. Each discharge valve 171 selectively connects and disconnects the corresponding combustion chamber 15 and the discharge passage 17.

A fuel injection valve 22 and a spark plug 23 are arranged in correspondence with each cylinder 12 in the cylinder head 11. Each fuel injection valve 22 directly injects fuel into the corresponding combustion chamber 15. Each spark plug 23 ignites the air-fuel mixture in the corresponding combustion chamber 15. The fuel injection valves 22 are connected to a delivery pipe 34. Each fuel injection valve 22 is connected to the delivery pipe 34 via a supply passage 35. The delivery pipe 34 is supplied with fuel from a fuel tank 37 through a fuel pump 36. Fuel is supplied to each fuel injection valve 22 through the corresponding supply passage 35 from the delivery pipe 34. The delivery pipe 34 is provided with a fuel pressure sensor 38 for detecting the fuel pressure in the pipe 34.

The engine 10 is provided with a crankshaft (not shown), which is an output axis, and at least one camshaft (not shown) for driving the intake valves 161 and the discharge valves 171. The camshaft rotates in accordance with the rotation of the crankshaft. A crank angle sensor 30 sends a predetermined pulse signal in accordance with the rotation of the crankshaft. A cam angle sensor 31 sends a predetermined pulse signal in accordance with the rotation of the camshaft. The cylinder block 13 is provided with a coolant temperature sensor 32 for detecting the temperature of the coolant (coolant temperature THW) in the engine 10.

Each sensor 21, 30, 31, 32, 38 sends a detection signal to an electronic control unit (ECU) 40 of the engine 10. The ECU 40 determines the running characteristics of the engine 10 based on the received detection signals. The ECU 40 computes the rotational phase of the crankshaft (crank angle CA) and the rotational speed of the crankshaft (engine speed) based on signals from the crank angle sensor 30 and the cam angle sensor 31. The ECU 40 executes a fuel injection control process and an ignition control process in accordance with the running characteristics of the engine 10. The ECU 40 is provided with a memory 41 for storing programs and data. The data may include a map used to perform the fuel injection control process and the ignition control process.

The ECU 40 switches the fuel injection mode in accordance with the running characteristics of the engine 10. The fuel injection mode is switched to and from the intake stroke injection mode and the compression stroke injection mode. In the intake stroke injection mode, fuel is injected during the intake stroke of each piston 14. In the compression stroke injection mode, fuel is injected during the compression stroke of each piston 14.

When cranking the engine 10, the ECU 40 selects the intake stroke injection mode as the fuel injection mode. In this mode, each fuel injection valve 22 injects fuel during the intake stroke of the corresponding piston 14. When each piston 14 completes its intake stroke and reaches the top dead center of the compression stroke, the mixture of the injected fuel and air is ignited. Therefore, in the intake stroke injection mode, the time period taken to ignite the air-fuel mixture after the fuel is injected is relatively long. Thus, there is enough time for the injected fuel to vaporize in each combustion chamber 15. As a result, the air-fuel mixture is ignited and burned in a stable manner and the engine 10 is reliably started.

After the engine 10 is cranked, the ECU 40 determines whether the coolant temperature THW during cranking of the engine 10, or the coolant temperature during cranking THWST, is greater than or equal to a predetermined warming completion temperature (for example, 80 degrees Celsius). The coolant temperature THW reflects the temperature of the engine 10. If the coolant temperature during cranking THWST is less than the warming completion temperature, the ECU 40 determines that the engine 10 is not warm, or the engine 10 is cold. Then, the ECU 40 selects the fuel injection mode in accordance with the coolant temperature during cranking THWST. More specifically, if the coolant temperature during cranking THWST is less than the warming completion temperature and within a predetermined temperature range, the ECU 40 selects the compression stroke injection mode as the fuel injection mode. If the coolant temperature during cranking THWST is less than the warming completion temperature and out of the predetermined temperature range, the ECU 40 selects the intake stroke injection mode as the fuel injection mode.

Figure 3:
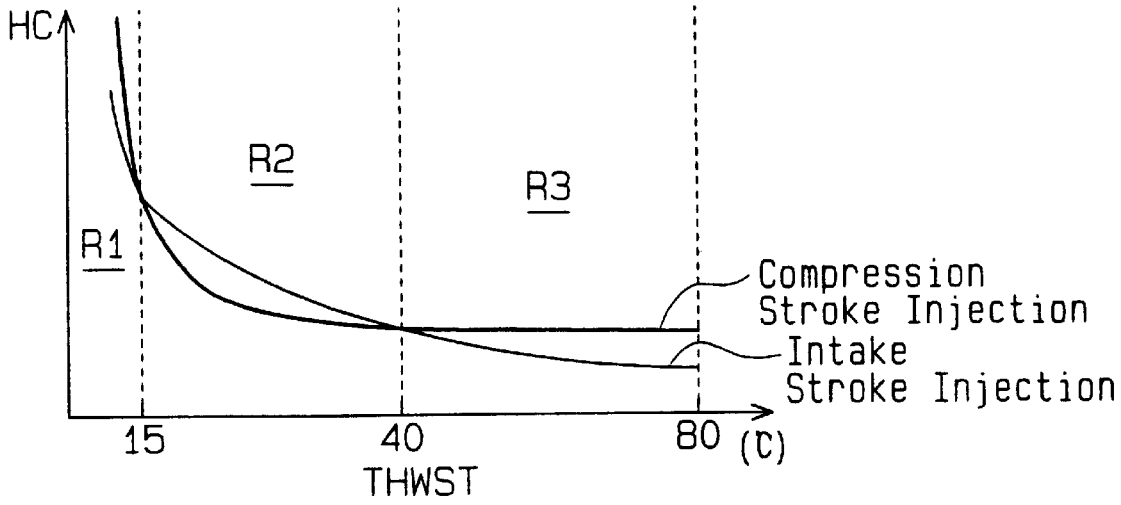
FIG. 3 is a graph illustrating the relationship between the coolant temperature during cranking THWST and the amount of unburned discharge gas (hydrocarbon) during the execution of each fuel injection mode.

For example, FIG. 3 shows the coolant temperature during cranking THWST when it is determined that the engine 10 is cold. The coolant temperature during cranking THWST is divided into a first temperature range R1, a second temperature range R2, and a third temperature range R3. The first temperature range R1 includes temperatures less than 15 degrees Celsius. The second temperature range R2 includes temperatures greater than or equal to 15 degrees Celsius and less than 40 degrees Celsius. The third temperature range R3 includes temperatures greater than or equal to 40 degrees Celsius and less than 80 degrees Celsius. In this case, 80 degrees Celsius is the warming completion temperature. When the coolant temperature during cranking THWST is within the second temperature range R2, the ECU 40 switches the fuel injection mode from the intake stroke injection mode to the compression stroke injection mode. When the coolant temperature during cranking THWST is within the first temperature range R1 or the third temperature range R3, the ECU 40 maintains the intake stroke injection mode as the fuel injection mode.

FIG. 3 shows a graph that illustrates the relationship between the coolant temperature during cranking THWST and the amount of unburned discharge gas (hydrocarbon (HC)) during the execution of each fuel injection mode. The graph indicates that when the coolant temperature during cranking THWST is within the second temperature range R2, the compression stroke injection mode provides less unburned discharge gas than the intake stroke injection mode. This is because the amount of injected fuel that adheres to the wall of each combustion chamber 15 is less in the compression stroke injection mode than in the intake stroke injection mode when the coolant temperature during cranking THWST is within the second temperature range R2. Thus, if the coolant temperature during cranking THWST is within the second temperature range R2 after the engine 10 is cranked in the intake stroke injection mode, the fuel injection mode is switched from the intake stroke injection mode to the compression stroke injection mode. This reduces the amount of unburned discharge gas.

If the coolant temperature during cranking THWST is within the third temperature range R3, the injected fuel hardly adheres to the wall of the combustion chambers 15 in both the intake stroke injection mode and the compression stroke injection mode. However, the time period taken to ignite the air-fuel mixture after fuel has been injected is longer in the intake stroke injection mode than in the compression stroke injection mode. Therefore, the injected fuel is more reliably vaporized in each combustion chamber 15 in the intake stroke injection mode. As shown in the graph of FIG. 3, if the coolant temperature during cranking THWST is within the third temperature range R3, the amount of unburned discharge gas (HC) is less in the intake stroke injection mode than in the compression stroke injection mode. Thus, if the coolant temperature during cranking THWST is within the third temperature range R3 after the engine 10 is cranked in the intake stroke injection mode, the fuel injection mode is kept in the intake stroke injection mode. This reduces the amount of unburned discharge gas.

When the intake stroke injection mode or the compression stroke injection mode is executed while the engine 10 is cold, the ECU 40 determines the fuel injection amount such that the air-fuel ratio matches the theoretical, or stoichiometric, air-fuel ratio. The fuel injection amount is determined in accordance with the running characteristics of the engine 10 such as the intake flow rate and the coolant temperature THW.

The coolant temperature THW gradually increases during the compression stroke injection mode while the engine 10 is cold. When the coolant temperature THW reaches a predetermined threshold temperature THWC, the ECU 40 switches the fuel injection mode from the compression stroke injection mode to the intake stroke injection mode. A predetermined temperature $\alpha$ degrees Celsius is added to the coolant temperature during cranking THWST, and the resultant is referred to as the threshold temperature THWC. The predetermined temperature $\alpha$ Celsius is greater than zero, that is, for example, 10 degrees Celsius.

When the coolant temperature THW reaches the threshold temperature THWC during the running of the engine 10, the temperature of the wall of each combustion chamber 15 is higher than the threshold temperature THWC. In this state, fuel hardly adheres to the wall of each combustion chamber 15 in both the intake stroke injection mode and the compression stroke injection mode. However, the time period taken to ignite the air-fuel mixture after fuel is injected is shorter in the compression stroke injection mode than in the intake stroke injection mode. In other words, the time period taken to vaporize the injected fuel is shorter in the compression stroke injection mode than in the intake stroke injection mode. Thus, the amount of unburned discharge gas increases. Therefore, when the coolant temperature THW reaches the threshold temperature THWC, the fuel injection mode is switched from the compression stroke injection mode to the intake stroke injection mode.

The intake flow rate required by the engine 10 when executing the compression stroke injection mode while the engine 10 is cold, is greater than that required when executing the intake stroke injection mode. Therefore, when switching fuel injection modes, the opening degree of the throttle valve 18 must be adjusted such that an intake flow rate is appropriate for the mode after switching. However, it takes time from when the throttle valve 18 is operated to when the actual intake flow rate reaches a required value.

Therefore, in this embodiment, the opening degree of the throttle valve 18 is adjusted in advance of switching the fuel injection mode between the intake stroke injection mode and the compression stroke injection mode while the engine 10 is cold. The opening degree of the throttle valve 18 (throttle opening degree) is adjusted in advance such that the flow rate of intake air to the combustion chamber 15 is appropriate for the fuel injection mode to be selected.

Figure 5:
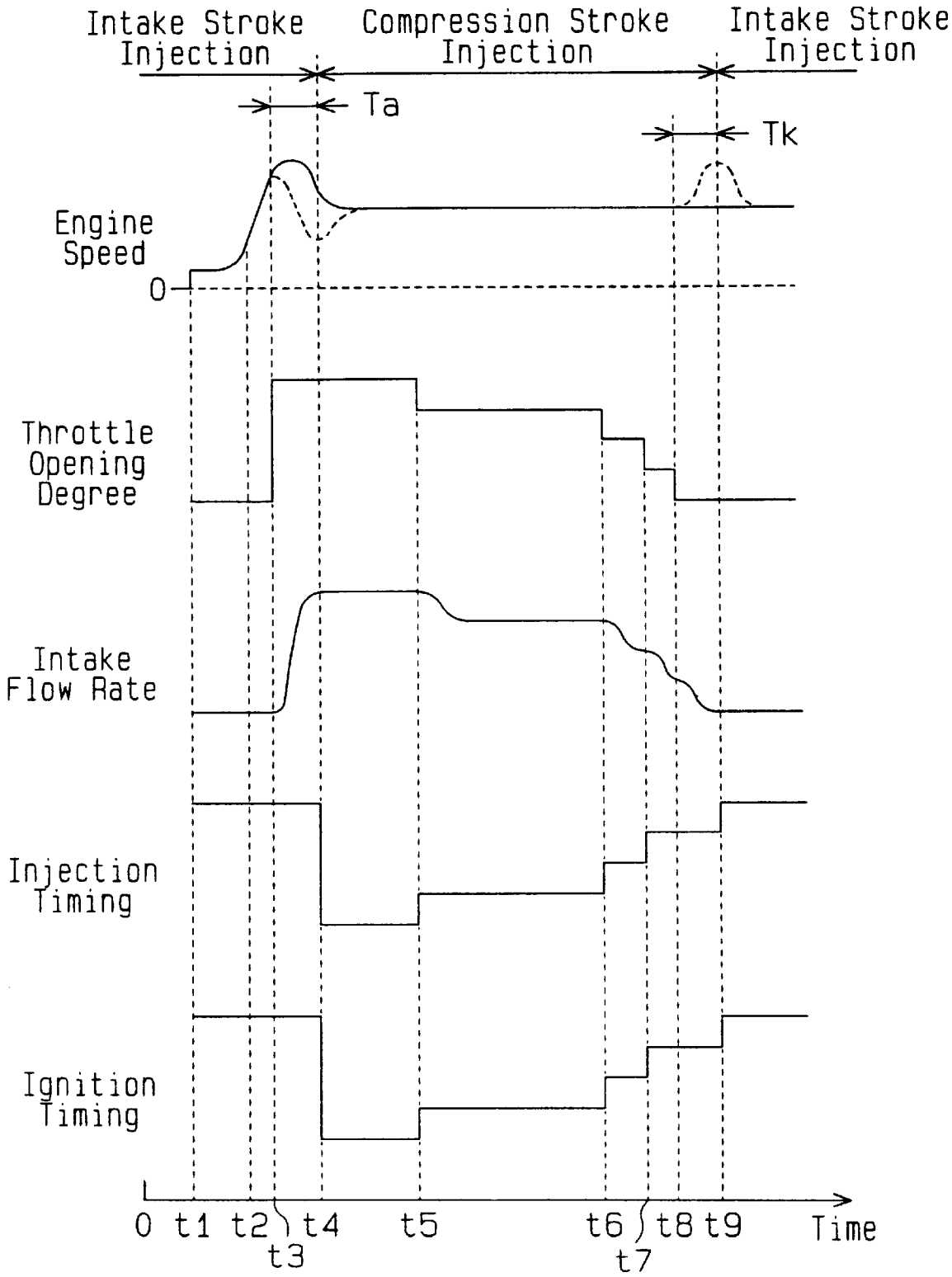
FIG. 5 is a time chart illustrating a control state of an engine when switching fuel injection modes.

For example, as shown in FIG. 5, the ECU 40 increases the throttle opening degree at time t3, which is before the time t4 at which the fuel injection mode is switched from the intake stroke injection mode to the compression stroke injection mode. Then, the intake flow rate is increased to be appropriate for the compression stroke injection mode. Time period Ta, from time t3 to time t4, is equivalent to the time period from when the throttle valve 18 is operated to increase the opening degree to when the actual intake flow rate reaches the appropriate amount for the compression stroke injection mode. The ECU 40 determines the fuel injection amount in accordance with the actual intake flow rate. Therefore, at time t4 at which the fuel injection mode is switched to the compression stroke injection mode, the fuel injection amount is appropriate for the compression stroke injection mode.

At time t8, which is before the time t9 at which the fuel injection mode is switched from the compression stroke injection mode to the intake stroke injection mode, the ECU 40 decreases the throttle opening degree such that intake flow rate is appropriate for the intake stroke injection mode. Time period Tk, from time t8 to time t9, is equivalent to the time period from when the throttle valve 18 is operated to decrease the opening degree to when the actual intake flow rate reaches an appropriate amount for the intake stroke injection mode. Therefore, at time t9 at which the fuel injection mode is switched to the intake stroke injection mode, the fuel injection amount is appropriate for the intake stroke injection mode.

During execution of the compression stroke injection mode when the engine 10 is cold, the ECU 40 advances the fuel injection timing in correspondence with the temperature increase of the engine 10. In this embodiment, the ECU 40 determines the temperature increase of the wall of each combustion chamber 15 in accordance with the decrease of the temperature difference $\Delta$THW between the threshold temperature THWC and the current coolant temperature THW. The temperature increase of the wall of each combustion chamber 15 is equivalent to the temperature increase of the engine 10. The ECU 40 refers to a map shown in FIG. 4 and determines the fuel injection timing in accordance with the temperature difference $\Delta$THW.

Figure 4:
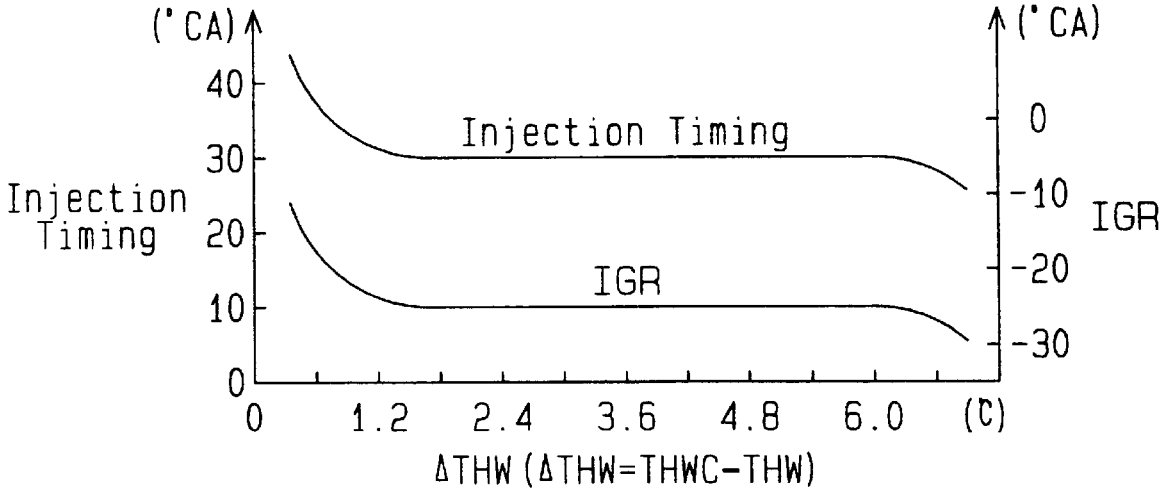
FIG. 4 is a map for determining the fuel injection timing and the ignition delay amount IGR during the execution of the compression stroke injection mode.

As shown in the map of FIG. 4, the fuel injection timing is advanced as the temperature difference $\Delta$THW decreases. In other words, the fuel injection timing is advanced as the coolant temperature THW increases towards the threshold temperature THWC. The fuel injection timing is represented by the rotational phase of the crankshaft, or the crank angle CA, of the engine 10. In the map of FIG. 4, the left vertical axis has units of degrees of crank angle CA. The crank angle CA represents the time period from when fuel is injected into each combustion chamber 15 to when the corresponding piston 14 is positioned at the top dead center of its compression stroke. In other words, the left vertical axis in the map of FIG. 4 shows the difference between the crank angle CA when fuel is injected into each combustion chamber 15 and the crank angle CA when the corresponding piston 14 is located at the top dead center of its compression stroke. Therefore, greater the crank angle CA of the vertical axis is, earlier the fuel injection timing is.

When the temperature of the engine 10 increases, the injected fuel is reliably vaporized and diffused. Thus, less injected fuel reaches the spark plug 23. On the other hand, the closer that the piston 14 is to the top dead center of the compression stroke, the higher the pressure in the combustion chamber 15 will be. Therefore, if the fuel injection timing is delayed, the fuel is injected when the pressure in the combustion chamber 15 is high. When the fuel is injected while the pressure in the combustion chamber 15 is relatively high, less injected fuel reaches the spark plug 23. Thus, if the temperature of the engine 10 increases when the fuel ignition timing is relatively delayed, the air-fuel mixture about the spark plug 23 is ignited in a lean state, which makes the combustion unstable.

However, as described in the preferred embodiment, the fuel injection timing is advanced in accordance with the temperature increase of the engine 10. This increases the difference between the pressure of the injected fuel and the pressure in the combustion chamber 15. Thus, the degree by which the pressure of the injected fuel is higher than the pressure in the combustion chamber 15 is increased. Therefore, even when the temperature of the engine 10 increases, the injected fuel reliably reaches the spark plug 23. Then, the air-fuel mixture about the spark plug 23 is ignited in a reach state. This allows a preferable ignition and combustion.

The catalytic device in the exhaust passage 17 provides a fully effective exhaust gas cleaning function only when it is warm. Therefore, during the execution of the compression stroke injection mode while the engine 10 is cold, the ECU 40 delays the ignition timing more than when the engine 10 is operated in a normal mode, or when the engine 10 is warm. This allows time to efficiently warm the catalytic device and to provide reliable combustion. More specifically, the ECU 40 determines a basic ignition timing in accordance with the running characteristics of the engine 10, which is based on factors such as the engine speed and the engine load. The ECU 40 refers to the map of FIG. 4 and determines an ignition delay amount IGR in accordance with the temperature difference ΔTHW. Then, the ECU 40 sets the actual ignition timing. The actual ignition timing is the basic ignition timing delayed by the ignition delay amount IGR.

As shown in the map of FIG. 4, the ignition delay amount IGR decreases as the temperature difference ΔTHW decreases. In other words, the ignition delay amount IGR decreases as the coolant temperature THW increases towards the threshold temperature THWC. According to the map of FIG. 4, the right vertical axis has units of degrees of negative crank angle CA. The basic ignition timing is referred to as zero and the ignition delay amount IGR is represented by the negative crank angle CA. As the absolute value of the crank angle CA of the vertical axis decreases, the ignition delay amount IGR decreases. The delay of the actual ignition timing with respect to the basic ignition timing is reduced accordingly. As the temperature of the engine 10 increases the ignition delay amount IGR decreases. The ignition timing is advanced accordingly.

As described above, the ignition timing is delayed when the compression stroke injection mode is executed while the engine 10 is cold. However, this decreases the torque of the engine 10. To compensate for the decrease of the engine torque, the ECU 40 adjusts the throttle opening degree such that the intake flow rate increases as the ignition delay amount IGR increases. More specifically, the ECU 40 determines a basic throttle opening degree in accordance with the running characteristics of the engine 10, such as the load applied to the engine 10 and the fuel injection mode. The ECU 40 determines a correction amount of the throttle opening degree in correspondence with the ignition delay amount IGR. The correction amount of the throttle opening degree increases as the ignition delay amount IGR increases. The ECU 40 adds the correction amount to the basic throttle opening degree and the resultant is referred to as the final throttle opening degree. Therefore, the intake flow rate increases as the ignition delay amount IGR increases, and the fuel injection amount increases accordingly. As a result, the decrease of the engine torque due to the delay control of the ignition timing is reduced.

Fuel injection control steps are described with reference to the timing chart of FIG. 5 and the flowcharts of FIGS. 2(*a*) and 2(*b*). The fuel injection control steps are executed when the engine 10 is cranked while it is cold. The ECU 40 executes the routine of the flowcharts at predetermined crank angles.

When the engine 10 is cranked at time t1 in FIG. 5, the ECU 40 selects the intake stroke injection mode as the fuel injection mode. In this case, the coolant temperature THWST is less than the warming completion temperature, that is, 80 degrees Celsius. When the cranking of the engine 10 is completed at time t2, in step 110 of FIG. 2(*a*), the ECU 40 determines whether the coolant temperature during cranking THWST is within the second temperature range R2 shown in the graph of FIG. 3.

Figure 2A:
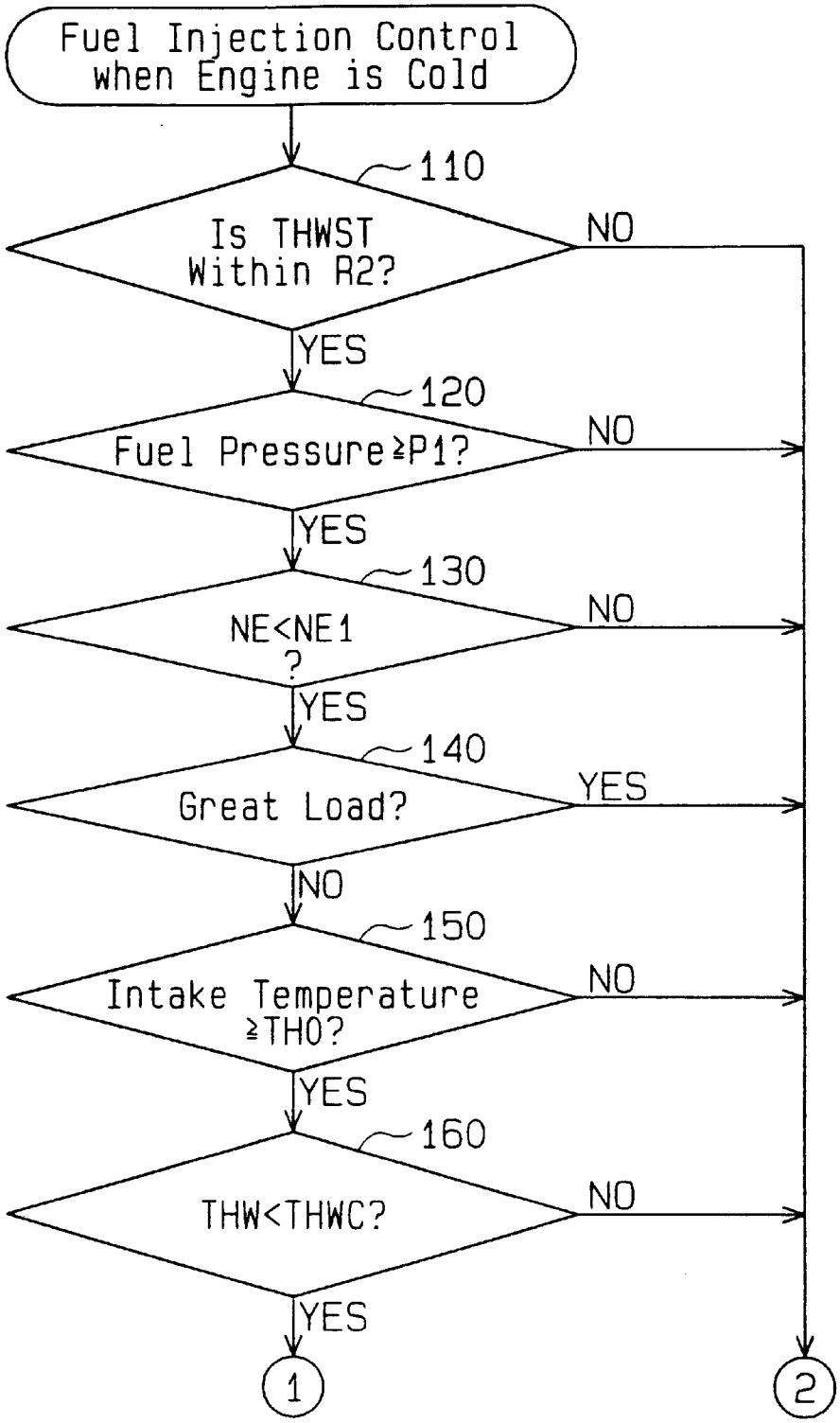
FIGS. 2(*a*) and 2(*b*) are flowcharts illustrating fuel injection control steps when the engine is cold.
Figure 2B:
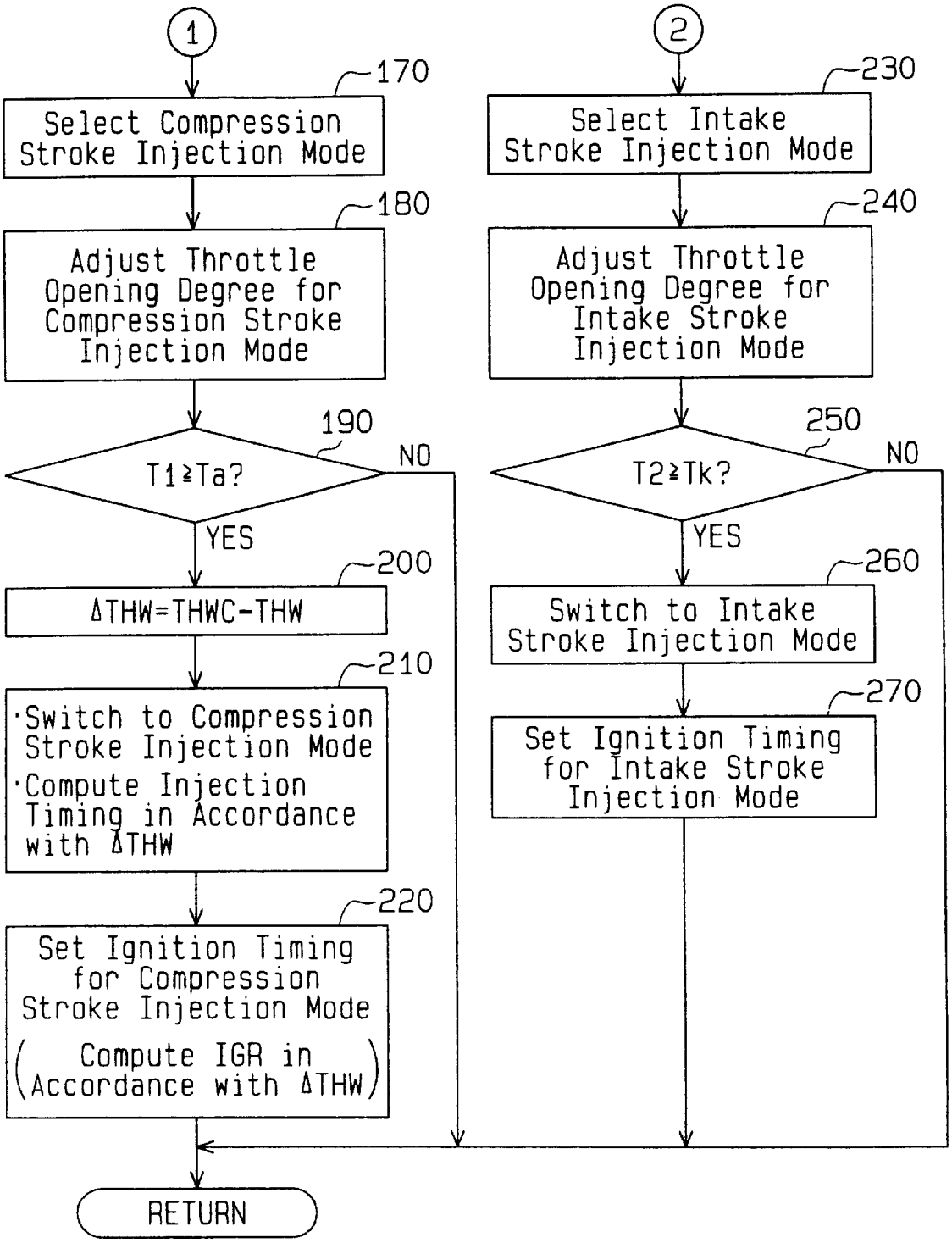

If the coolant temperature during cranking THWST is not within the second temperature range R2, that is, when the coolant temperature during cranking THWST is within the first or third temperature range R1, R3, the ECU 40 proceeds to step 230 of FIG. 2(*b*). In step 230, the ECU 40 selects the intake stroke injection mode assuming that conditions for executing the intake stroke injection mode are met. However, selecting the intake stroke injection mode does not mean that the fuel injection mode is actually switched to the intake stroke injection mode. In step 230, the intake stroke injection mode is merely selected, and the ECU 40 continues operating in the current fuel injection mode. If the coolant temperature during cranking THWST is within the second temperature range R2, the ECU 40 proceeds to step 120 of FIG. 2(*a*).

In step 120, the ECU 40 determines whether the fuel pressure detected by the fuel pressure sensor 38 is greater than or equal to a predetermined pressure P1. The predetermined pressure P1 is the pressure required to execute the compression stroke injection mode. If the fuel pressure is less than the predetermined pressure P1, the compression stroke injection cannot be executed. Thus, the ECU 40 proceeds to step 230 of FIG. 2(*b*). If the fuel pressure is greater than or equal to the predetermined pressure P1, the compression stroke injection can be executed. Thus, the ECU 40 proceeds to step 130.

In step 130, the ECU 40 determines whether the engine speed NE is less than a predetermined speed NE1. The predetermined speed NE1 is the maximum value of the engine speed NE when the engine 10 is idling. When the engine speed NE is greater than or equal to the predetermined speed NE1, the time allowed for vaporizing the injected fuel is insufficient in the compression stroke injection mode. Therefore, the ECU 40 proceeds to step 230 of FIG. 2(*b*). When the engine speed NE is less than the predetermined speed NE1, the compression stroke injection can be executed. Thus, the ECU 40 proceeds to step 140.

In step 140, the ECU 40 determines whether the load applied to the engine 10 is great based on the depression amount of the acceleration pedal 20. When the load applied to the engine 10 is great, the fuel injection amount increases. Thus, the fuel concentration of the air-fuel mixture formed about the plug 23 becomes excessive in the compression stroke injection mode. Therefore, the ECU 40 proceeds to step 230 of FIG. 2(*b*) when the load applied to the engine 10 is great. When the load applied to the engine 10 is small, the compression stroke injection can be executed. Thus, the ECU 40 proceeds to step 150.

In step 150, the ECU 40 determines whether the temperature in the intake passage 16 (intake temperature) is greater than or equal to a predetermined temperature TH0. When the intake temperature is less than the predetermined temperature TH0, the amount of unburned discharge gas increases in the compression stroke injection mode. Thus, the ECU 40 proceeds to step 230 of FIG. 2(*b*). When the intake temperature is greater than or equal to the predetermined temperature TH0, the compression stroke injection can be executed. Thus, the ECU 40 proceeds to step 160.

In step 160, the ECU 40 determines whether the current coolant temperature THW is less than the threshold temperature THWC (THWC=THWST+$\alpha$). If the current coolant temperature THW is greater than or equal to the threshold temperature THWC, the ECU 40 proceeds to step 230 of FIG. 2(*b*). If the current coolant temperature THW is less than the threshold temperature THWC, the ECU 40 proceeds to step 170 of FIG. 2(*b*).

In step 170, the ECU 40 selects the compression stroke injection mode assuming that conditions for executing the compression stroke injection mode are met. However, selecting the compression stroke injection mode does not mean that the fuel injection mode is actually switched to the compression stroke injection mode. In step 170, the compression stroke injection mode is merely selected, and the ECU 40 continues operating in the current fuel injection mode.

In step 180, the ECU 40 adjusts the throttle opening degree such that the intake flow rate is appropriate for the compression stroke injection mode. This occurs at time t3 in FIG. 5. For example, when the fuel injection mode is the intake stroke injection mode when the compression stroke injection mode is selected, the throttle opening degree is changed from a level appropriate for the intake stroke injection mode to a level appropriate for the compression stroke injection mode at time t3 in FIG. 5. In this case, as shown in FIG. 5, the actual intake flow rate gradually increases after the throttle opening degree is changed.

In step 190, the ECU 40 determines whether and elapsed time period T1 from when the compression stroke injection mode is selected is greater than or equal to predetermined time period Ta. If the elapsed time period T1 is less than predetermined time period Ta, the ECU 40 temporarily terminates the routine. Therefore, the intake stroke injection mode continues and the compression stroke injection mode is not executed. As long as the predetermined time period Ta has not elapsed from the time when the compression stroke injection mode was selected, the intake stroke injection mode is executed with a fuel injection amount corresponding to the current intake flow rate.

In step 190, if the elapsed time length T1 is judged to be greater than or equal to the predetermined time period Ta (see time t4 in FIG. 5), the ECU 40 proceeds to step 200. In step 200, the ECU 40 computes the temperature difference ΔTHW between the threshold temperature THWC and the current coolant temperature THW. As shown in FIG. 5, the actual intake flow rate reaches a level appropriate for the compression stroke injection mode at time t4. Time t4 is when the predetermined time period Ta has elapsed.

In step 210, the ECU 40 switches the fuel injection mode to the compression stroke injection mode. The ECU 40 refers to the map of FIG. 4 and computes the fuel injection timing in accordance with the temperature difference ΔTHW. If the current fuel injection mode is the compression stroke injection mode, the compression stroke injection mode continuous as the fuel injection mode. In step 220, the ECU 40 refers to the map of FIG. 4. and computes the ignition delay amount IGR in accordance with the temperature difference ΔTHW. The ECU 40 adjusts the ignition timing to be appropriate for the compression stroke injection mode and temporarily terminates the routine.

Therefore, after the predetermined time period Ta has elapsed from when the compression stroke injection mode is selected, the compression stroke injection mode is executed with the appropriate intake flow rate and the fuel injection amount corresponding to the intake flow rate.

The temperature of the engine 10 increases as the steps 110, 120, 130, 140, 150, 160, 170, 180, 190, 200, 210, and 220 are executed repeatedly. Accordingly, the throttle opening degree gradually decreases, and the fuel injection timing and the ignition timing are gradually advanced (see times t4, t5, t6, and t7 in FIG. 5).

The coolant temperature THW increases as the engine 10 runs in the compression stroke injection mode. When the coolant temperature THW is greater than or equal to the threshold temperature THWC, the outcome in step 160 is negative. Thus, in step 230, the intake stroke injection mode is selected.

When the intake stroke injection mode is selected in step 230, the ECU 40 adjusts the throttle opening degree such that the intake flow rate is appropriate for the intake stroke injection mode in step 240. For example, when the current fuel injection mode is the compression stroke injection mode, the throttle opening degree is adjusted to be appropriate for the intake stroke injection mode at time t8 in FIG. 8. In this case, as shown in FIG. 5, the actual intake flow rate gradually decreases after the throttle opening degree is changed.

In step 250, the ECU 40 determines whether an elapsed time period T2 from when the intake stroke injection mode is selected is greater than or equal to the predetermined time period Tk. If the elapsed time period T2 is less than the predetermined time period Tk, the ECU 40 temporarily terminates the routine. Therefore, the compression stroke injection mode continues and the intake stroke injection mode is not executed. As long as the predetermined time period Tk has not elapsed from when the intake stroke injection mode was selected, the compression stroke injection mode is executed with a fuel injection amount corresponding to the current intake flow rate.

In step 250, if the elapsed time period T2 is judged to be greater than or equal to the predetermined time period Tk (see time t9 in FIG. 5), the ECU 40 proceeds to step 260. In step 260, the ECU 40 switches the fuel injection mode to the intake stroke injection mode. If the current fuel injection mode is the intake stroke injection mode, the intake stroke injection mode continues as the fuel injection mode. As shown in FIG. 5, the actual intake flow rate reaches the level appropriate for the intake stroke injection mode at time t9. Time t9 is when the predetermined time period Tk has elapsed. In step 270, the ECU 40 determines the ignition timing such that the timing is appropriate for the intake stroke injection mode and temporarily terminates the routine.

Therefore, the intake stroke injection mode is executed with the appropriate intake flow rate and with a fuel injection amount corresponding to the intake flow rate after the predetermined time period Tk elapses from when the intake stroke injection mode is selected.

The preferred embodiment provides the following advantages.

Before switching the fuel injection mode from the intake stroke injection mode to the compression stroke injection mode when the engine 10 is cold, the throttle opening degree is adjusted. The throttle opening degree is adjusted in advance such that the flow rate of intake air to the combustion chamber 15, or the intake flow rate, is appropriate for the selected fuel injection mode. The fuel injection mode is actually switched after the predetermined time period elapses from when the throttle opening degree is adjusted. Therefore, at the time the fuel injection mode is switched, the actual intake flow rate and the fuel injection amount, which is determined in accordance with the intake flow rate, are appropriate. Thus, fluctuations of the engine speed caused by switching the fuel injection mode are reduced.

When the coolant temperature during cranking THWST of the engine 10 is within the predetermined temperature range (the second temperature range R2 of FIG. 3), the compression stroke injection mode is selected as the fuel injection mode. This reduces the amount of unburned discharge gas when the engine 10 is cold.

When executing the compression stroke injection mode while the engine 10 is cold, the fuel injection timing is advanced in accordance with the increase of the temperature of the engine 10. As a result, the engine 10 reduces the amount of unburned discharge gas, provides improved ignition and combustion, and provides stable idling.

When the coolant temperature THW reaches the predetermined threshold temperature THWC, or the sum of the coolant temperature during cranking THWST and the predetermined temperature $\alpha$ Celsius, the fuel injection mode is switched from the compression stroke injection mode to the intake stroke injection mode. The temperature of the wall of each combustion chamber 15, that is, the temperature increase of the engine 10, is appropriately determined based on the decrease of the temperature difference $\Delta$THW between the threshold temperature THWC and the current coolant temperature THW. Therefore, the fuel injection timing is determined in accordance with the temperature increase of the engine 10 during execution of the compression stroke injection mode.

When executing the compression stroke injection mode while the engine 10 is cold, the ignition delay amount IGR is decreased in accordance with the temperature increase of the engine 10. As a result, the time period between the fuel injection and the ignition is appropriately determined. This maintains the desired combustion and efficiently warms the catalytic device.

When the temperature inside the intake passage 16 (intake temperature) is less than the predetermined temperature TH0, the intake stroke injection mode is selected as the fuel injection mode regardless of the coolant temperature during cranking THWST. This reduces the amount of unburned discharge gas.

When the coolant temperature THW reaches the threshold temperature THWC, the fuel injection mode is switched from the compression stroke mode to the intake stroke injection mode. This reduces the amount of unburned discharge gas.

The preferred embodiment of the present invention may be changed as follows.

According to the embodiment described in FIGS. 1 to 5, the fuel injection timing is advanced in accordance with the decrease of the temperature difference $\Delta$THW between the threshold temperature THWC and the current coolant temperature THW. In addition, the fuel injection timing may be advanced in accordance with the increase of the temperature difference between the coolant temperature during cranking THWST and the current coolant temperature THW. Similarly, the ignition delay amount IGR may be changed in accordance with the temperature difference between the coolant temperature during cranking THWST and the current coolant temperature THW.

According to the embodiment described in FIGS. 1 to 5, the fuel injection mode is switched from the compression stroke injection mode to the intake stroke injection mode when the coolant temperature THW reaches the threshold temperature THWC. In this case, the threshold temperature THWC is the sum of the coolant temperature during cranking THWST and the predetermined temperature a degrees Celsius. In addition, the wall of each combustion chamber 15 may be detected directly. Then, if the temperature of each combustion chamber 15 reaches a predetermined temperature, the fuel injection mode may be switched from the compression stroke injection mode to the intake stroke injection mode.

Therefore, the present examples and embodiments are to be considered as illustrative and not restrictive and the invention is not to be limited to the details given herein, but may be modified within the scope and equivalence of the appended claims.

What is claimed is:

1. A control apparatus for an engine, wherein the engine includes an injector that directly injects fuel into a combustion chamber and a valve for controlling the flow rate of intake air to the combustion chamber, wherein the engine is operated in a fuel injection mode selected from a first injection mode, in which the injector injects fuel during the compression stroke of the engine, and a second injection mode, in which the injector injects fuel during the intake stroke of the engine, wherein the intake flow rate appropriate for the first injection mode differs from the intake flow rate appropriate for the second injection mode, the apparatus comprising a controller for controlling the injector and the valve, wherein, when one of the fuel injection modes is selected, the controller controls the valve such that the intake flow rate is appropriate for the selected fuel injection mode, and when the engine is cold, the controller determines the amount of fuel to be injected by the injector in accordance with the actual intake flow rate, and the controller controls the valve such that the intake flow rate is appropriate for the selected fuel injection mode before actually switching the fuel injection mode by a predetermined time period.

2. The apparatus according to claim 1, wherein the intake flow rate appropriate for the first injection mode is greater than the intake flow rate appropriate for the second injection mode.

3. The apparatus according to claim 1, wherein the predetermined time period is equivalent to a time period from when the valve is controlled to when the actual intake flow rate is appropriate for the selected fuel injection mode.

4. The apparatus according to claim 1, further comprising an spark plug for igniting the fuel injected into the combustion chamber, wherein, when the first injection mode is executed while the engine is cold, the controller controls the spark plug such that the ignition timing is delayed relative to a timing used when the engine is warm.

5. The apparatus according to claim 4, wherein the controller decreases the delay amount of the ignition timing as the engine temperature increases.

6. The apparatus according to claim 4, wherein, when the first injection mode is executed while the engine is cold, the controller increases the intake flow rate according to the delay of the ignition timing.

7. The apparatus according to claim 1, wherein, when the first injection mode is executed while the engine is cold, the controller controls the injector to advance the fuel injection timing in accordance with an increase of the engine temperature.

8. The apparatus according to claim 1, wherein, when cranking the engine, the controller selects the second injection mode, and when the engine is cold during the cranking of the engine, the controller switches the fuel injection mode from the second injection mode to the first injection mode.

9. The apparatus according to claim 8, wherein, when the engine temperature reaches a threshold temperature, which is equivalent to the sum of the temperature during cranking and a predetermined temperature, during execution of the first injection mode, the controller selects the second injection mode.

10. A control apparatus for an engine, wherein the engine includes an injector that directly injects fuel into a combustion chamber and a throttle valve for adjusting the flow rate of intake air to the combustion chamber, wherein the engine is operated in a fuel injection mode selected from a first injection mode, in which the injector injects fuel during the compression stroke of the engine, and a second injection mode, in which the injector injects fuel during the intake stroke of the engine, wherein the intake flow rate appropriate for the first injection mode is greater than the intake flow rate appropriate for the second injection mode, the apparatus comprising:

injector control means, wherein, when the engine is cold, the injector control means determines the amount of fuel to be injected from the injector in accordance with the actual intake flow rate; and throttle control means, wherein, when one of the fuel injection modes is selected, the throttle control means controls the throttle valve such that the intake flow rate is appropriate for the selected fuel injection mode, and the throttle control means controls the throttle valve such that the intake flow rate is appropriate for the selected fuel injection mode before the fuel injection mode is actually switched by a predetermined time period.

11. The apparatus according to claim 10, wherein the predetermined time period is equivalent to a time period from when the throttle valve is controlled to when the actual intake flow rate is appropriate for the selected fuel injection mode.

12. A method for controlling an engine that directly injects fuel into a combustion chamber, wherein the method includes:

operating the engine in a selected one of a plurality of fuel injection modes, wherein the injection modes include a first injection mode, in which the fuel is injected during the compression stroke of the engine, and a second injection mode, in which the fuel is injected during the intake stroke of the engine, wherein the intake flow rate appropriate for the first injection mode differs from the intake flow rate appropriate for the second injection mode;

adjusting the intake flow rate to be appropriate for the selected fuel injection mode;

determining the amount of fuel injected into the combustion chamber in accordance with the actual intake flow rate when the engine is cold; and when a different injection mode is selected, switching the injection mode to the selected injection mode after a delay that is sufficient to allow the intake flow rate to reach a level appropriate for the selected fuel injection mode.

* * * * *